US008783195B2

(12) United States Patent
Pakarinen

(10) Patent No.: US 8,783,195 B2
(45) Date of Patent: Jul. 22, 2014

(54) STEERING FUNNEL FOR BED MATERIAL IN FLUIDIZED BED BOILER, FLUIDIZED BED BOILER AND METHOD IN FLUIDIZED BED BOILER

(75) Inventor: Juha Pakarinen, Varkaus (FI)

(73) Assignee: Yit Teollisuus- JA Verkkopalvelut Oy, Varkaus (FI)

( * ) Notice: Subject to any disclaimer, the term of this patent is extended or adjusted under 35 U.S.C. 154(b) by 369 days.

(21) Appl. No.: 12/997,309

(22) PCT Filed: Jun. 11, 2009

(86) PCT No.: PCT/FI2009/050498

§ 371 (c)(1),
(2), (4) Date: Dec. 10, 2010

(87) PCT Pub. No.: WO2009/150302

PCT Pub. Date: Dec. 17, 2009

(65) Prior Publication Data

US 2011/0088601 A1 Apr. 21, 2011

(30) Foreign Application Priority Data

Jun. 11, 2008 (FI) ..... 20085573

(51) Int. Cl.
*F23G 5/30* (2006.01)
*F23C 10/24* (2006.01)
*F27B 15/09* (2006.01)

(52) U.S. Cl.
USPC ..... 110/245

(58) Field of Classification Search
CPC ..... F23C 10/00–10/32; F27B 15/00–15/20; F23G 2203/50–2203/505; F23G 5/30
USPC ..... 110/245; 122/4 D
See application file for complete search history.

(56) References Cited

U.S. PATENT DOCUMENTS 2,812,592 A * 11/1957 Knibbs et al. ..... 432/58
4,400,150 A 8/1983 Smith et al.

(Continued)

FOREIGN PATENT DOCUMENTS

DE 1831982 5/1961
FR 2763577 A1 11/1998

(Continued)

OTHER PUBLICATIONS

International Search Report for PCT/FI2009/050498, Apr. 14, 2010.

(Continued)

*Primary Examiner* — Kenneth Rinehart
*Assistant Examiner* — David J Laux
(74) *Attorney, Agent, or Firm* — Stiennon & Stiennon

(57) ABSTRACT

A fluidized bed boiler (1) has a furnace (5) limited by walls (2), a grate (3) and a roof (4). Below the grate (3) in connection with the furnace (5) is arranged a steering funnel (7) in which bed material removed from the furnace (5) is led downwards. Into the steering funnel (7), between its upper and lower edge, are arranged guide plates (14, 15, 19), which are substantially divergent from the surface of the steering funnel (7), for guiding a flow of the bed material inside the steering funnel (7). The guide plates (14, 15, 19) aim to equalize the flow of the material inside the steering funnel (7) for example by preventing the development of a core flow between an inlet (24) and outlet connection (25) of the steering funnel and at the same time to get the bed material to flow on the whole cross-sectional area of the steering funnel (7).

25 Claims, 4 Drawing Sheets

(56) References Cited

U.S. PATENT DOCUMENTS

| | | | | |
|---|---|---|---|---|
| 4,448,134 | A * | 5/1984 | Foote | 110/245 |
| 4,805,405 | A * | 2/1989 | Jonsson | 110/266 |
| 4,901,675 | A * | 2/1990 | Brown et al. | 110/263 |
| 6,263,837 | B1 * | 7/2001 | Utunen et al. | 110/245 |

FOREIGN PATENT DOCUMENTS

| | | | |
|---|---|---|---|
| JP | 2004301358 | | 10/2004 |
| JP | 2004301358 | A | 10/2004 |
| JP | 2006242454 | | 9/2006 |

OTHER PUBLICATIONS

Written Opinion of the International Searching Authority for PCT/FI2009/050498, Dec. 11, 2010.

Search Report for FI20085573, Apr. 21, 2009.

* cited by examiner

STEERING FUNNEL FOR BED MATERIAL IN FLUIDIZED BED BOILER, FLUIDIZED BED BOILER AND METHOD IN FLUIDIZED BED BOILER

CROSS REFERENCES TO RELATED APPLICATIONS

This application is a U.S. national stage application of International App. No. PCT/FI2009/050498, filed Jun. 11, 2009, which claims priority on FI 20085573, filed Jun. 11, 2008, the disclosures of which are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a steering funnel for bed material in a fluidized bed boiler, a fluidized bed boiler and a method in a fluidized bed boiler. The invention especially relates to a new method for guiding flows of material to be removed from a fluidized bed boiler.

An ordinary fluidized bed boiler essentially comprises a furnace limited by vertical walls, a bottom and a roof. A fluidized bed formed of solid matter particles like sand is maintained in the furnace. A typical fluidized bed boiler comprises feeding means for feeding fuel, fluidized bed material and air to the furnace. Flue gases are led away from the furnace to an exhaust duct for flue gases. At the bottom of the furnace there is a grate in which feeding elements of air, like air nozzles, are typically arranged. Air needed for burning of fuel and for fluidization of bed material is fed from air nozzles to the bottom of the furnace. Fluidization air is typically used as primary air of combustion process. On the grate are also arranged elements like openings or gaps for removing solid matter, i.e. bed material, ash, and impurities among them, to underside of the grate. Below the openings or gaps of the grate is typically arranged one or more channels or pockets, which are in this text called funnels, along which material to be removed from the furnace is led in a controlled manner from the furnace to the underside of the boiler. There usually are shutters on the bottom end of the funnels, by means of which the volume of the material to be removed from the furnace is controlled. Material to be removed from the funnels is usually led to a conveyor and onwards to further processing. Material is removed from the funnels at the need, typically periodically, for example a few times an hour in a normal operating situation.

On the underside of the grate there can be a windbox, inside which said funnels are at least partially arranged. Fluidization air is led to the windbox, i.e. around funnels, and fluidization air is led from the windbox to the air feeding elements above the grate. Typically air is heated in the windbox with the heat of bed material streaming downwards in the funnels. At the same time, bed material in the funnels is cooling.

One problem in a fluidized bed boiler is a high proportion of incombustible particles contained in some fuels, such as construction waste or logging waste, such as stumps: metals, stones, concrete, etc., that accumulate on the bottom of the furnace and interfere with fluidization of sand. The above-mentioned problem has been solved by designing the bottom of the furnace to better remove bed material, for example by enlarging discharge openings of material that lead through the grate. In this manner, also impurities at the bottom of the furnace are removed from the furnace with the bed material.

Due to the downwards tapering form of one or more funnels below the grate, the flow in the funnel is not always steady. A so-called core flow usually tends to develop at the discharge opening in the bottom of the funnel or to the center of the funnel. This means that material normally flows faster downwards at the center of the funnel than at the edges of the funnel. Because in fluidized bed boilers the cross-sectional area of the bottom of the furnace, i.e. the bed, is typically considerably larger than the area of discharge openings at the bottom of the funnel or funnels, material is removed irregularly from the furnace. Sometimes material is removed in fluidized bed boilers only from said core flow area of the bottom of the furnace.

As a result of irregular discharge of material, unburnt material accumulates to piles in the bottom of the bed hindering fluidization, and it may cause a partial or total melting of bed material.

Because of an irregular flow of material, a part of the material may even be permanently stationary or move very slowly on the edges of the funnels. This disturbs heat transfer between air flowing in the windbox and bed material. In this case, the material to be removed from the funnels, having flown in the core flow, does not have enough time to cool down as desired in the funnel. On the other hand, air blown to the furnace is not pre-heated in a desired manner in the wind box.

SUMMARY OF THE INVENTION

It is an object of the present invention to reduce or even eliminate the above-mentioned problems appearing in the prior art.

The present invention has especially an object of providing a solution for achieving a discharge of material that is as regular as possible from the whole bottom area of the fluidized bed boiler.

An object of the present invention is to reduce so-called core flow which tends to develop to the center of a steering funnel for bed material in a fluidized bed boiler.

An object of the present invention is to intensify the functioning of a fluidized bed boiler.

An object of the present invention is to intensify heat transfer between air of the windbox and material to be removed from a fluidized bed boiler.

The embodiment examples and advantages mentioned in this text relate, where applicable, as well to a steering funnel, a fluidized bed boiler, a method, an inner funnel as to uses according to the invention, even though it is not always specifically mentioned.

The embodiments of the invention are suitable to be used in connection with boilers utilizing different fluidization techniques. In this text, the term fluidized bed boiler is used for all different boilers utilizing fluidized bed technique. Fluidized bed boilers are for example circulating fluidized bed boilers, i.e. circulating bed boilers (CFB boilers) or bubbling fluidized bed boilers, i.e. bubbling bed boilers (BFB boilers).

A typical fluidized bed boiler according to the invention comprises a furnace limited by walls, a grate and a roof. Below the grate in the connection with the furnace is arranged a steering funnel according to the invention, in which bed material removed from the furnace is led downwards. In this connection, for the sake of simplicity, only bed material is referred to, even though it is obvious that simultaneously also impurities are removed from the furnace.

A typical steering funnel according to the invention is mainly downwards tapering on its horizontal cross-section. This means that the upper edge of the funnel is larger by its surface area than its lower edge. In the steering funnel there may be vertical or even partly downwards expanding sections. The upper edge of the steering funnel comprises an inlet connection through which the bed material is led into the steering funnel. The lower edge comprises an outlet connection through which bed material is removed from the steering funnel. The outlet connection usually comprises a shutter, like a gate valve, by means of which a flow of the material to be removed from the steering funnel can be guided. In the typical steering funnel of the invention, bed material and elements flowing with it are thus led along their path between an inlet and outlet connection. According to the invention, into the steering funnel, between its upper and lower edge, are arranged guide plates, which are substantially divergent from the surface of the steering funnel, for guiding the flow of the bed material inside the steering funnel. It is an aim of the guide plates to level the flow of material inside the steering funnel for example by preventing the development of a core flow between an inlet and outlet connection.

In an embodiment of the invention the guide plates are arranged so that the flow of bed material is maintained on mainly the whole cross-sectional area of the steering funnel. Thus, it is not an aim to totally prevent or stop the vertical flow of the bed material, but the flow is guided. The flow, which takes place on as large area as possible of the steering funnel, means that at least not big air pockets, i.e. points where there is no bed material, are formed to the steering funnel, nor at least large points, where bed material does not flow, are formed. This kind of air pockets or points without a flow may in some embodiments of the solution according to the invention cover for example less than 30%, less than 20%, less than 10%, less than 5%, less than 3%, less than 2% or less than 1% of horizontal cross-sectional area in the steering funnel when bed material is removed in a normal operating situation of the invention.

In an embodiment of the invention guide plates slow down a downwards directed flow of bed material above the outlet connection of the steering funnel. Thus, the guide plates for example throttle the flow of the bed material at the center of the steering funnel and facilitate flowing of the material near the edges of the steering funnel.

In an embodiment of the invention a free vertical path leads through the steering funnel from an inlet connection of the upper edge to an outlet connection of the lower edge in the steering funnel. In other words, if bed material has completely been removed from this kind of steering funnel, there is a visual contact along a vertical line from the inlet connection of the upper edge to the outlet connection of the lower edge of the steering funnel. Bed material can thus flow at least in theory also along a straight path through the steering funnel and between guide plates.

In an embodiment of the invention, below the grate of a fluidized bed boiler is arranged a windbox through which and thence onwards air needed for burning and fluidization of bed material is led through a grate to a furnace. Thus, a steering funnel according to the invention is typically arranged mainly inside the windbox of a fluidized bed boiler. A steady flow of bed material to be removed from the furnace on the whole cross-section of the steering funnel produces a more regular retention of material in the steering funnel as compared with material flowing in a core flow according to prior art. The stabilization of the retention time results in more effective and more regular cooling of the material, which makes its later processing in conveyors and silos easier.

Now it has now been surprisingly found that by means of simple guide plates turning the flow and arranged inside the steering funnel, the removal of the material from the bottom of the fluidized bed boiler can be efficiently evened out. Furthermore, by means of the invention heat transfer between the air flowing in the windbox and the material traveling in the steering funnel can be simply increased.

In an embodiment of the invention, guide plates comprise several separate plates and bed material can flow in the spaces between the plates. Guide plates can be placed on various heights in the steering funnel or mainly to the same height with each other. Guide plates can be of different sizes or they can be equal in size with each other.

In an embodiment of the invention, guide plates are formed as an inner funnel into which leads an inlet opening and from which leads an outlet opening. Between the inlet and outlet opening, there are walls of the inner funnel. In an embodiment of the invention the walls are at least mainly closed so that bed material can reach inside the funnel only from the inlet opening and away from the funnel only from the outlet opening. In an embodiment of the invention, openings from which bed material can flow inside the funnel or out of it are formed on the walls.

In an embodiment of the invention, guide plates are formed inside the steering funnel as a substantially downwards tapering inner funnel. The inner funnel efficiently throttles the material flow leading through it and prevents the formation of a core flow by it.

The inner funnel has typically a conical shape, for example a truncated rectangular pyramid shape. Its size is adjusted to be suitable for each steering funnel. A minimum inner diameter of the inner funnel, i.e. a minimum opening from which the material must flow when it travels through it, can be for example less than 2000 mm, 200 to 2000 mm, 200 to 1000 mm, 250 to 500 mm or 300 to 500 mm. One steering funnel can have one or more inner funnels, for example 1, 2, 3, 4 or 5.

In an embodiment of the invention, a part of the bed material is led along an inner path, i.e. through an inner funnel. Another part of the material is led along an outer path, i.e. between the inner funnel and the steering funnel. When the inner funnel is slowing down the flow inside it, material on the outer path can flow better.

In an embodiment of the invention guide plates, for example an inner funnel, are arranged to the center part of a steering funnel. This is usually most efficient because usually the core flow of bed material tends to develop right to the center of the steering funnel. For example, the inner funnel can be arranged straight above the outlet connection of the steering funnel. In an embodiment, the inner funnel is arranged symmetrically in relation to the steering funnel, when considering the horizontal cross-section of the steering funnel.

In an embodiment of the invention, an inner funnel is at a distance from all inner walls of the steering funnel. In this manner, bed material can be led from around the inner funnel on substantially all its sides.

In an embodiment of the invention, a steering funnel and an inner funnel have substantially the same or congruent shape in their horizontal cross-section. For example, both may have a cross-section with the shape of squares, circles or rectangles the length ratios of the sides of which are equal.

In an embodiment of the invention, a steering funnel and an inner funnel have substantially different shapes in their horizontal cross-section. For example, one may have a circular horizontal cross-section and the other may be angular.

In an embodiment of the invention, guide plates are arranged between a steering funnel and an inner funnel. In this manner, a flow of bed material can be guided more efficiently also in the vicinity of the walls of the steering funnel.

In an embodiment of the invention, a steering funnel has a rectangular horizontal cross-section. Then, in an embodiment the aim is to intensify a flow of the material in the vicinity of the angles of the rectangle. This can be done, for example, by placing extra guide plates which turn the flow, between the inner funnel and the steering funnel, into the area between the angles of the rectangle. In an embodiment of the invention the inner funnel and said extra guide plates are one and the same piece. Then they can be for example retrofitted as one piece in an already existing, steering funnel.

The invention also relates to an inner funnel as such, which funnel is intended inside a steering funnel in a fluidized bed boiler, as well as to the use of downwards tapering funnel and guide plates inside a steering funnel for preventing a core flow of bed material inside a steering funnel.

BRIEF DESCRIPTION OF THE DRAWINGS

The invention is described in more detail below with reference to the enclosed schematic drawings.

DESCRIPTION OF THE PREFERRED EMBODIMENTS

For the sake of clarity, the same reference numbers are used for corresponding parts in different embodiments.

Figure 1:
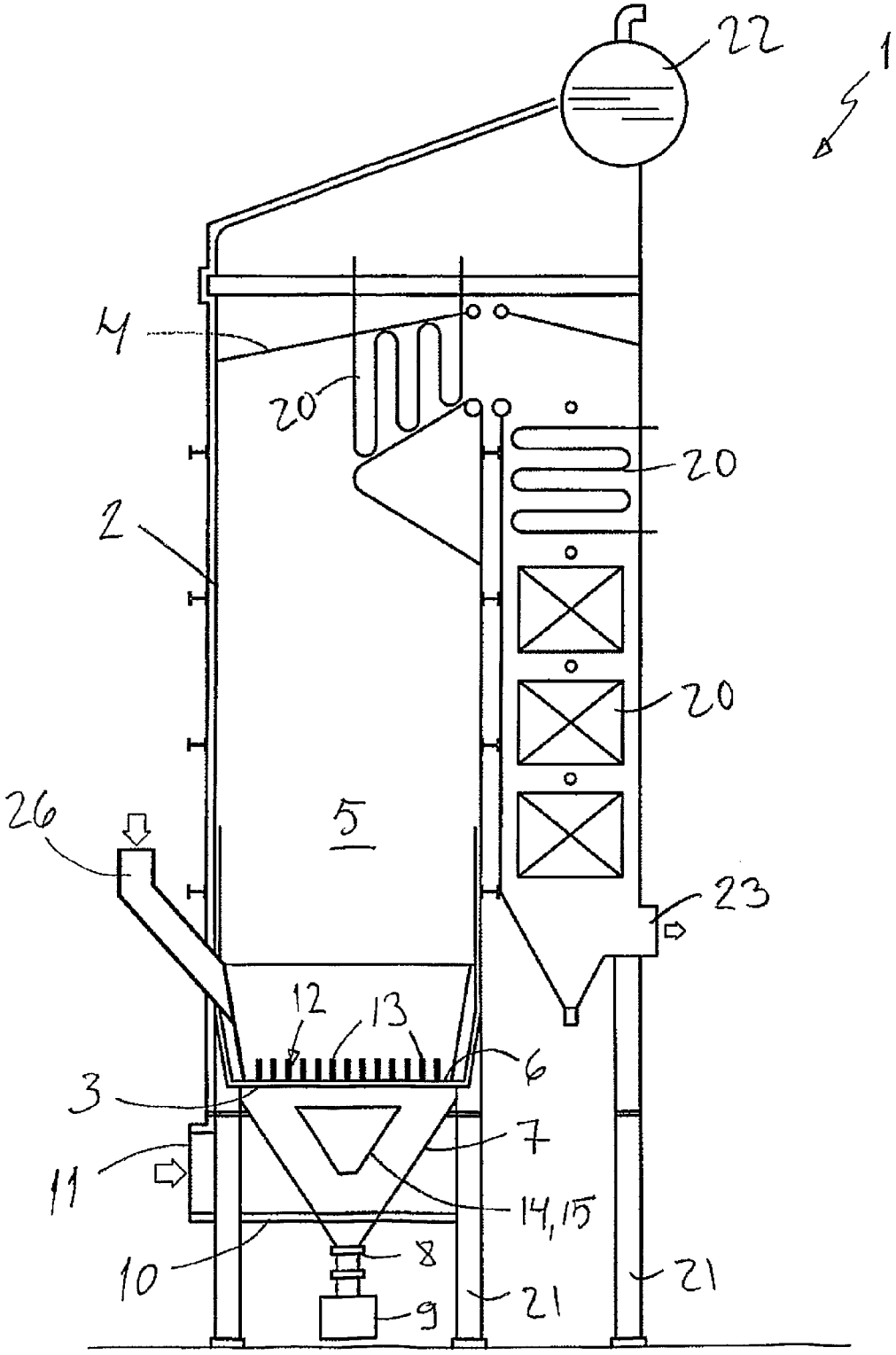
FIG. 1 shows a fluidized bed boiler according to the invention.

FIG. 1 shows a bubbling fluidized bed boiler, i.e. a bubbling bed boiler 1 according to the invention. The boiler comprises a furnace 5 limited by walls 2, a grate 3 and a roof 4. Through the grate lead openings 6 from which material inside the furnace is guided below the grate into a steering funnel 7. Inside the steering funnel 7 bed material removed from the furnace and impurities among it are led further downwards. There is at the lower end of the steering funnel a damper 8 via which material is guided to a conveyor 9 and onwards to further processing.

Below the grate is arranged a windbox 10. The steering funnel 7 is mainly inside it. To the windbox 10 air needed for burning and fluidization of bed material is led from a connection 11. Air travels through the windbox 10 upwards via air nozzles 13 in a nozzle surface 12 formed onto the grate 3 to the lower part of the furnace 5.

Inside the steering funnel 7 are arranged guide plates 14 which form an inner funnel 15. A part of the material to be removed from the furnace 5 leads through the inner funnel 15. A part of the material flows between the inner funnel 15 and the steering funnel 7.

FIG. 1 also shows other parts of a fluidized bed boiler, like different heat exchangers 20, beams 21 supporting the boiler, a steam drum 22, an outlet connection 23 of flue gas as well as an inlet assembly 26 for fuel and bed material which are not an aim of this invention as such and are not explained in further detail here.

Figure 2:
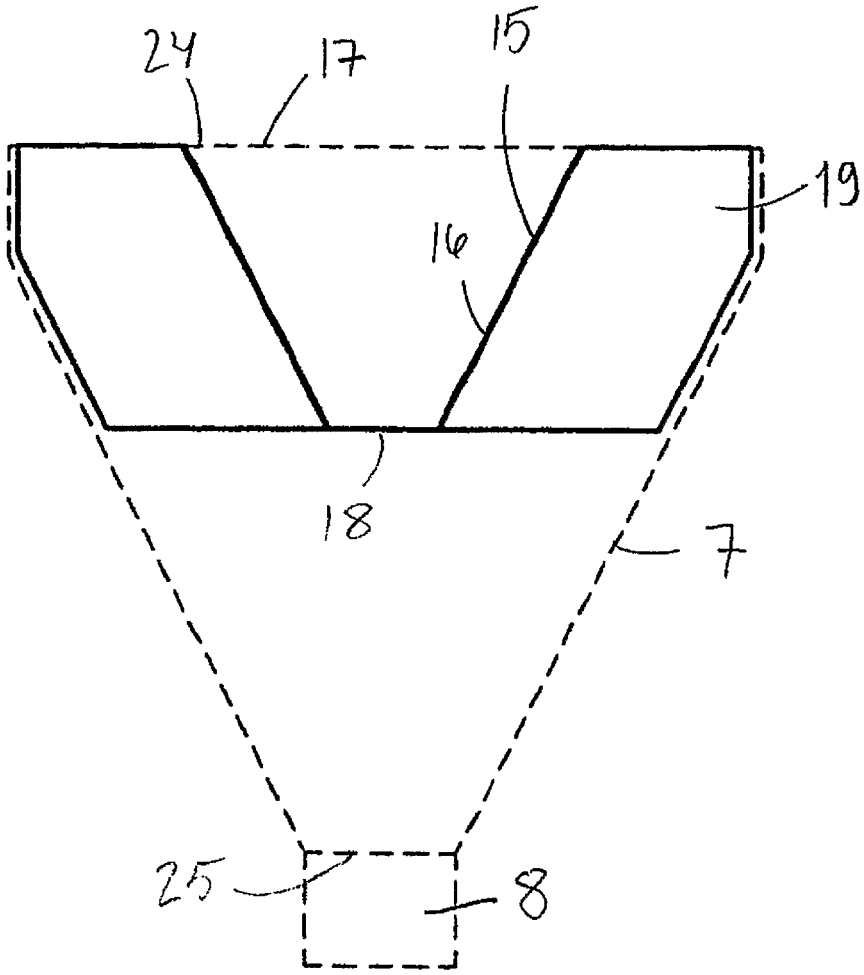
FIG. 2 shows a side-view of an inner funnel in a steering funnel according to the invention.
Figure 3:
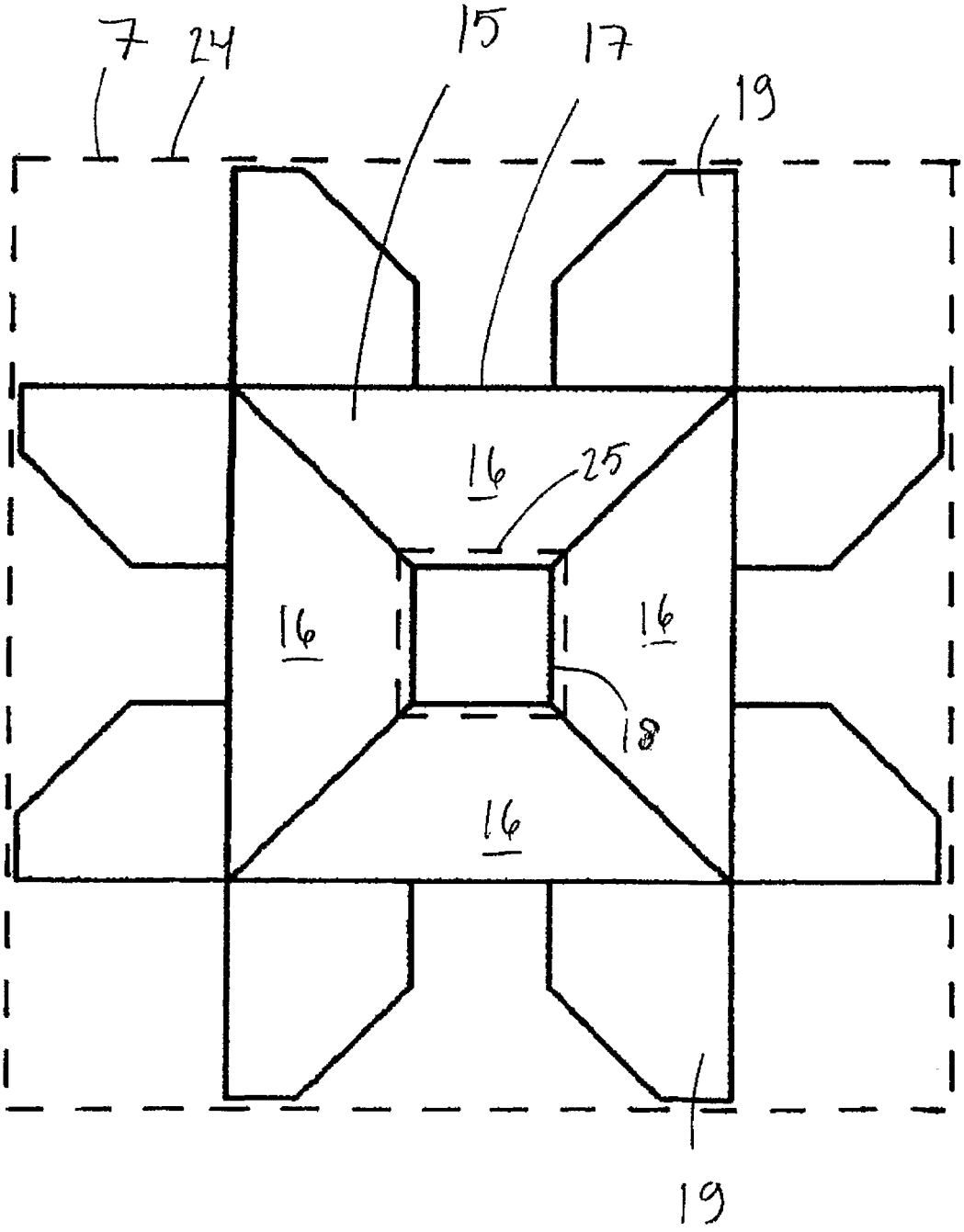
FIG. 3 shows the inner funnel and the steering funnel of FIG. 2 as seen from above.
Figure 4:
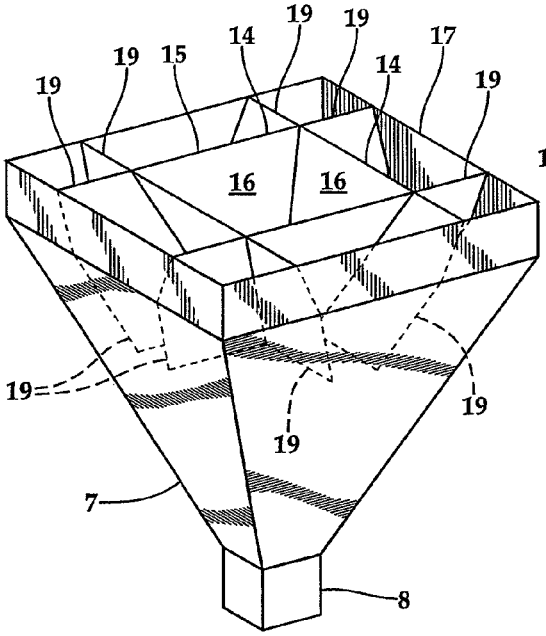
FIG. 4 is an isometric view of the inner funnel and the steering funnel of FIGS. 2 and 3.
Figure 6:
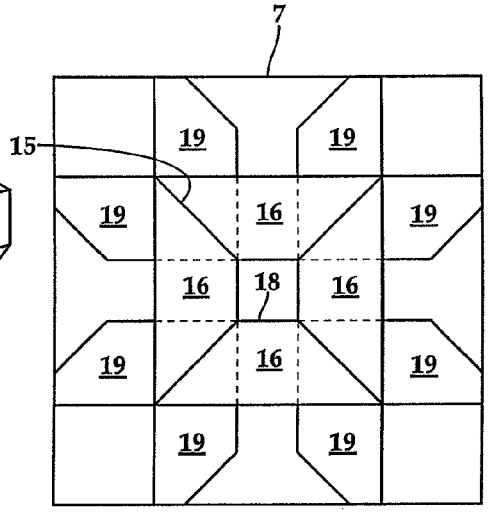
FIG. 6 is a top plan view taken along line 6-6 of the of the inner funnel and the steering funnel of FIG. 5.
Figure 5:
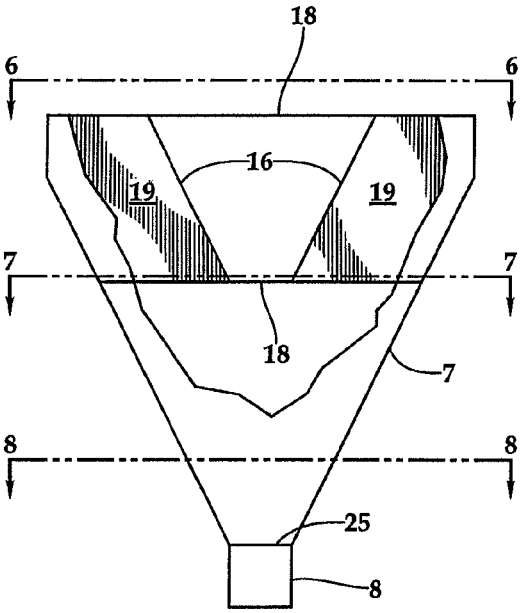
FIG. 5 is a front elevational view partially cut away in section of the inner funnel and the steering funnel of FIG. 4.
Figure 7:
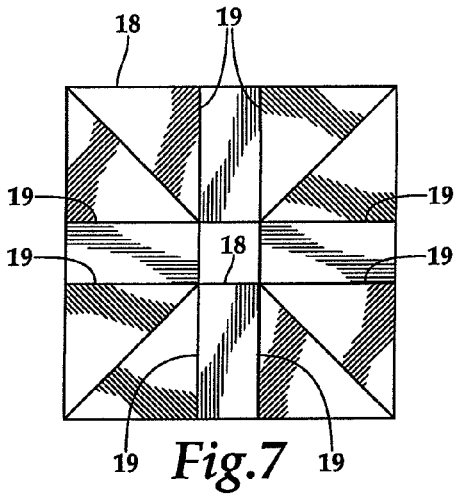
FIG. 7 is a cross-sectional view taken along section line 7-7 of the inner funnel and the steering funnel of FIG. 5.
Figure 8:
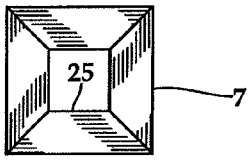
FIG. 8 is a cross-sectional view taken along section line 8-8 of the of the inner funnel and the steering funnel of FIG. 5.

FIGS. 2 and 3 show with broken lines a steering funnel 7 according to the invention, inside which there is an inner funnel 15. There is an inlet opening 24 for material on the upper edge of a steering funnel 7, which opening is intended against the grate 3, and on the lower edge there is an outlet opening 25 for material, in which opening a damper 8 is attached.

A rectangular inner funnel 15 has inclined side walls 16, and thus the funnel is downwards tapering on its horizontal cross-section. The upper edge of the inner funnel 15 comprises an inlet opening 17 for material and the lower edge comprises an outlet opening 18 which is smaller than the inlet opening. The inlet opening 17 of the inner funnel is arranged approximately to the same height as the inlet opening 24 of the steering funnel. The outlet opening 18 of the inner funnel opens approximately to the middle of the height of the steering funnel 7, a little above the midpoint. The outlet opening 18 has a diameter somewhat smaller than the outlet opening 25. The funnel 15 throttles a material flow at the center of the steering funnel, i.e. at the outlet opening 25, thus creating a condition for easier flowing of material between the inner funnel 15 and the outer funnel, i.e. the steering funnel 7. To the outer edges of the funnel 15 are attached extra guide plates 19. They throttle the flow of material outside the inner funnel 15 from the angles of the walls 16 towards the center of the walls. From the FIG. 3 it can be seen how a free path remains for the material downwards between the steering funnel 7 and the corners of the inner funnel 15.

Without the inner funnel 15 according to the invention, there would be a danger of forming a core flow for bed material at the center of the steering funnel 7. Particularly, there would be a danger that at the corners of the steering funnel, i.e. also at the corners of the furnace, hardly any bed material could flow below the grate.

Even though guide plates arranged inside the steering funnel 7 are shown in the form of a funnel in the figures, it is obvious that also guide plates of other shapes can be arranged to guide the flows according to the invention.

The figures show only a few preferred embodiments according to the invention. Facts of secondary importance with regards to the main idea of the invention, facts known as such or evident for a person skilled in the art, such as power sources or support structures possibly required by the invention, are not separately shown in the figures. Fluidized bed technique is known as such, and the operation of boilers is not explained in further detail here. It is apparent to a person skilled in the art that the invention is not limited exclusively to the examples described above, but that the invention can vary within the scope of the claims presented below. The dependent claims present some possible embodiments of the invention, and they are not to be considered to restrict the scope of protection of the invention as such.

The invention claimed is:

1. A steering funnel for bed material in a fluidized bed boiler, the steering funnel comprising:

a steering funnel upper edge comprising an inlet connection for leading bed material from a furnace to a location inside the steering funnel;

a steering funnel lower edge comprising a steering funnel outlet connection for removing bed material from the steering funnel, a vertical flow axis being defined extending from the inlet connection to the outlet connection; wherein the steering funnel has a horizontal cross-section with a cross-sectional area at every point along the flow axis; and a path for bed material arranged between the inlet and outlet connections, wherein inside the steering funnel between its upper and lower edge are arranged a plurality of guide plates at least some of which extend inwardly from an inner surface defined by the steering funnel and are angled so as to substantially divert bed material horizontally across the inner surface as it flows downwardly along the inner surface of the steering funnel and wherein the guide plates are arranged inside the steering funnel so that the flow of bed material is maintained on mainly the whole cross-sectional area of the steering funnel at each of said cross-sections.

2. The steering funnel of claim 1, wherein the steering funnel has four corners and the guide plates which extend inwardly from the inner surface defined by the steering funnel are arranged to direct the bed material from the furnace along the inner surface of the steering funnel and away from the corners and in a downwards directed flow of bed material above the outlet connection of the steering funnel.

3. The steering funnel of claim 1 wherein the steering funnel has a center, and wherein guide plates are arranged to extend toward the center of the steering funnel.

4. The steering funnel of claim 1, wherein some of the plurality of guide plates are arranged inside the steering funnel as a mainly downwards tapering inner funnel so that the flow of material is split between the steering funnel and the inner funnel, such that a portion of the flow of material flows only through the inner funnel, and a portion of the flow of material flows only between the inner funnel and the outer funnel.

5. The steering funnel of claim 4 wherein the inner funnel is arranged substantially at a center of the steering funnel.

6. The steering funnel of claim 4 wherein at least one inner path of bed material is arranged to lead through the inner funnel and at least one outer path of bed material is arranged to lead between the inner funnel and the steering funnel.

7. The steering funnel of claim 4 wherein the inner funnel is at a distance from the steering funnel on all its sides.

8. The steering funnel of claim 4 wherein the steering funnel defines horizontal cross-sections which are mainly a rectangle, a square or a circle.

9. The steering funnel of claim 4 wherein the steering funnel defines horizontal cross-sections and the inner funnel defines horizontal cross-sections which are mainly the same shape as the steering funnel horizontal cross-sections.

10. The steering funnel of claim 4 wherein the steering funnel and the inner funnel have a different shape on their horizontal cross-sections.

11. The steering funnel of claim 10 wherein one of the steering funnel and the inner funnel is circular on its horizontal cross-sections and the other is angular in its horizontal cross-sections.

12. The steering funnel of claim 4 wherein the steering funnel has a free vertical path from the inlet connection to the outlet connection.

13. A steering funnel for bed material in a fluidized bed boiler, the steering funnel comprising:

a steering funnel upper edge comprising an inlet connection for leading bed material from a furnace to a location inside the steering funnel;

a steering funnel lower edge comprising a steering funnel outlet connection for removing bed material from the steering funnel; and a path for bed material arranged between the inlet and outlet connections, wherein inside the steering funnel between its upper and lower edge are arranged a plurality of guide plates for guiding a flow of bed material inside the steering funnel, and wherein the guide plates are arranged inside the steering funnel so as to permit a flow of bed material on substantially a whole cross-sectional area defined by the horizontal cross-section of the steering funnel;

wherein some of the plurality of guide plates are arranged inside the steering funnel as a mainly downwards tapering inner funnel so that the flow of material is split between the steering funnel and the inner funnel, and wherein some of the guide plates of the plurality of guide plates are arranged between the steering funnel and the inner funnel.

14. The steering funnel of claim 13 wherein the steering funnel defines horizontal cross-sections of the steering funnel, the horizontal cross-sections further defining corners, and between the steering funnel and the inner funnel, in an area between the corners of the steering funnel some of the plurality of guide plates are arranged for intensifying the flow of bed material at the corners of the steering funnel.

15. The steering funnel of claim 14 wherein the plurality of guide plates are joined to form a single piece.

16. A fluidized bed boiler comprising:

a furnace limited by walls, a grate and a roof;

a steering funnel arranged below the grate for leading bed material from the furnace downwards, wherein the steering funnel further comprises:

an upper edge comprising an inlet connection for leading bed material from the furnace into the steering funnel;

a lower edge comprising an outlet connection for removing bed material from the steering funnel; and a path for bed material arranged between the inlet and outlet connections, wherein inside the steering funnel between its upper and lower edge are arranged a plurality of guide plates at least some of which are substantially divergent from a surface of the steering funnel which they abut, for guiding a flow of bed material inside the steering funnel, and wherein the guide plates are arranged inside the steering funnel so as to permit a flow of bed material on substantially a whole cross-sectional area defined by the horizontal cross-section of the steering funnel;

wherein some of the plurality of guide plates are arranged inside the steering funnel as a mainly downwards tapering inner funnel arranged substantially at the center of the steering funnel so that the flow of material is split between the steering funnel and the inner funnel, such that a portion of the flow of material flows only through the inner funnel, and a portion of the flow of material flows only between the inner funnel and the outer funnel.

17. The fluidized bed boiler of claim 16 wherein below the grate there is a windbox arranged for leading air through the grate to the furnace; and wherein the steering funnel is arranged mainly inside the windbox.

18. A method in a fluidized bed boiler comprising the steps of:

transferring material from a bottom of a furnace of a fluidized bed boiler into a steering funnel below the furnace, through an upper edge of the steering funnel;

guiding the material downward inside the steering funnel, to form a downward directed flow of material;

removing material from a lower edge of the steering funnel, the lower edge forming an outlet connection of the steering funnel;

guiding a flow of material inside the steering funnel between the upper edge and the lower edge, with a plurality of guide plates at least some of which extend inwardly from an inner surface defined by the steering funnel and are angled so as to substantially divert bed material horizontally across the inner surface as it flows downwardly along the inner surface of the steering funnel, and wherein the plurality of guide plates guide the flow of material downwards on substantially a whole of a cross-sectional area of the steering funnel so hindering development of a core flow inside the steering funnel.

19. The method of claim 18 wherein the downward directed flow of material is slowed down by the plurality of guide plates above the outlet connection of the steering funnel.

20. The method of claim 18 wherein a windbox is arranged below the furnace, wherein the steering funnel is arranged mainly inside the windbox, and wherein the method further comprises:

leading air to the windbox;

cooling material inside the steering funnel by means of the air and simultaneously heating the air with heat energy of the material in the steering funnel; and leading heated air to the furnace.

21. The method of claim 18 wherein some of the plurality of guide plates are arranged to form a mainly downwards tapering inner funnel inside the steering funnel;

wherein a first part of the material is led along an inner path through the inner funnel; and wherein a second part of the material is led along an outer path between the inner funnel and the steering funnel.

22. The method of claim 21 further comprising the step of slowing down a flow of material at the center of the steering funnel by means of the inner funnel.

23. The method of claim 21 further comprising leading material along the outer path substantially from all sides of the inner funnel.

24. The method of claim 20 further comprising leading a part of the flow of material through the steering funnel along a vertical path from an inlet connection of the upper edge in the steering funnel to the outlet connection of the lower edge.

25. A method in a fluidized bed boiler comprising the steps of:

transferring material from a bottom of a furnace of a fluidized bed boiler into a steering funnel below the furnace, through an upper edge of the steering funnel;

guiding the material downward inside the steering funnel, to form a downward directed flow of material;

removing material from a lower edge of the steering funnel, the lower edge forming an outlet connection of the steering funnel;

guiding a flow of material inside the steering funnel between the upper edge and the lower edge, with a plurality of guide plates; and wherein the plurality of guide plates guide the flow of material downwards on substantially a whole of a cross-sectional area of the steering funnel so hindering development of a core flow inside the steering funnel;

wherein some of the plurality of guide plates are arranged to form a mainly downwards tapering inner funnel inside the steering funnel;

wherein a first part of the material is led along an inner path through the inner funnel; and wherein a second part of the material is led along an outer path between the inner funnel and the steering funnel;

wherein a horizontal cross-section of the steering funnel is mainly a rectangle which defines corners, and wherein the method further comprises:

slowing down a flow of material by some of the plurality of guide plates arranged in an area between the corners of the steering funnel, and thus intensifying a flow of material at the corners of the steering funnel.

* * * * *